US011383279B2

(12) United States Patent
Tachibana

(10) Patent No.: US 11,383,279 B2
(45) Date of Patent: Jul. 12, 2022

(54) PLATE THICKNESS CONTROL DEVICE AND PLATE THICKNESS CONTROL METHOD

(71) Applicant: TOSHIBA MITSUBISHI-ELECTRIC INDUSTRIAL SYSTEMS CORPORATION, Chuo-ku (JP)

(72) Inventor: Minoru Tachibana, Tokyo (JP)

(73) Assignee: TOSHIBA MITSUBISHI-ELECTRIC INDUSTRIAL SYSTEMS CORPORATION, Chuo-ku (JP)

( * ) Notice: Subject to any disclaimer, the term of this patent is extended or adjusted under 35 U.S.C. 154(b) by 0 days.

(21) Appl. No.: 16/979,668

(22) PCT Filed: Jun. 14, 2019

(86) PCT No.: PCT/JP2019/023668
§ 371 (c)(1),
(2) Date: Sep. 10, 2020

(87) PCT Pub. No.: WO2020/250424
PCT Pub. Date: Dec. 17, 2020

(65) Prior Publication Data

US 2021/0394245 A1 Dec. 23, 2021

(51) Int. Cl.
*B21B 37/18* (2006.01)
*B21B 1/26* (2006.01)

(52) U.S. Cl.
CPC ..... *B21B 37/18* (2013.01); *B21B 1/26* (2013.01)

(58) Field of Classification Search
CPC ..... B21B 2001/225; B21B 1/26; B21B 31/24; B21B 37/18; B21B 37/60; B21B 37/74;
(Continued)

(56) References Cited

U.S. PATENT DOCUMENTS 3,044,330 A * 7/1962 Roberts ..... B21B 37/74 72/12.2
3,103,138 A * 9/1963 Wallace ..... B21B 37/54 72/9.4

(Continued)

FOREIGN PATENT DOCUMENTS

JP 52-142650 11/1977
JP 56-71521 A * 6/1981 ..... B21B 38/00

(Continued)

OTHER PUBLICATIONS

Translation; JP 56-71521 A; Hosono, Jun. 1981.*

(Continued)

*Primary Examiner* — Edward T Tolan
(74) *Attorney, Agent, or Firm* — Oblon, McClelland, Maier & Neustadt, L.L.P.

(57) ABSTRACT

A plate thickness control device controlling plate thickness of a hot rolling mill that includes a rolling stand. The plate thickness control device includes: a pyrometer disposed on an entry side of the rolling stand; a difference calculation part that outputs a difference temperature between a lock-on temperature of the plate-to-be-rolled measured by the pyrometer and a measurement value of a portion other than a tip portion of the plate-to-be-rolled measured by the pyrometer; a tracking part that transfers the difference temperature from the position of the pyrometer to immediately below the rolling stand based on plate speed of the plate-to-be-rolled; and a computation part that calculates a screw-down amount of the rolling stand based on the difference temperature transmitted from the tracking part.

6 Claims, 2 Drawing Sheets

(58) Field of Classification Search
CPC ..... B21B 38/006; B21B 2261/20; B21B 2263/12; B21B 2263/16; B21B 2273/20; B21B 37/16; B21B 37/62; B21B 38/04
See application file for complete search history.

(56) References Cited

U.S. PATENT DOCUMENTS

| | | | | | |
|---|---|---|---|---|---|
| 3,248,916 | A * | 5/1966 | Kenyon | B21B 37/16 | 72/8.4 |
| 3,411,332 | A * | 11/1968 | Cook | B21B 37/74 | 72/8.5 |
| 3,974,672 | A * | 8/1976 | Herbst | B21B 37/62 | 72/14.1 |
| 4,346,575 | A * | 8/1982 | Shibahara | B21B 37/22 | 72/12.7 |
| 4,481,800 | A * | 11/1984 | Ruhl | B21B 37/165 | 72/11.4 |
| 8,945,319 | B2 * | 2/2015 | Tachibana | B21C 51/00 | 148/511 |
| 2017/0028452 | A1 * | 2/2017 | Inami | C21D 1/42 | |

FOREIGN PATENT DOCUMENTS

| | | | |
|---|---|---|---|
| JP | 62-263817 | A | 11/1987 |
| JP | 8-255003 | A | 10/1996 |
| JP | 9-253723 | A | 9/1997 |
| JP | 2000-288613 | A | 10/2000 |
| JP | 2007-75850 | A | 3/2007 |
| WO | WO 2011/132273 | A1 | 10/2011 |

OTHER PUBLICATIONS

Translation; JP 62-263817 A; Hiramitsu, Nov. 1987.*
Office Action dated Feb. 16, 2021 in corresponding Indian Patent Application No. 202017008961 (with English Translation), 5 pages.
International Search Report dated Aug. 6, 2019 in PCT/JP2019/023668 filed on Jun. 14, 2019 (with Translation of Category of Cited Documents).
International Preliminary Report on Patentability and Written Opinion dated Dec. 23, 2021 in PCT/JP2019/023668 (with English translation), 18 pages.

* cited by examiner

PLATE THICKNESS CONTROL DEVICE AND PLATE THICKNESS CONTROL METHOD

TECHNICAL FIELD

The present application relates to a plate thickness control device and a plate thickness control method.

BACKGROUND

For example, as described in Japanese Patent Application Laid-Open No. 2007-75850, there is known a plate thickness control device improved so as to suppress a plate thickness deviation due to a skid mark. In the art according to this publication, a component of the skid mark is extracted by filtering plate thickness data from a plate thickness meter. By using this extracted plate thickness change, control is performed to suppress the plate thickness deviation due to the skid mark.

CITATION LIST

Patent Literature

[PTL 1] JP 2007-75850 A

SUMMARY

Technical Problem

In hot-rolled finishing plate thickness control technique, it is considered that the plate thickness deviation due to the skid mark is suppressed by gauge meter AGC or feed forward AGC or the like. The gauge meter AGC is a method of detecting a change in a plate thickness on an entry side of a rolling mill as a change in a roll force, and adjusting a screw-down amount of rolls with respect to the detected change in the force. The feed forward AGC is a method of detecting a change in a plate thickness with a plate thickness meter provided on an entry side of a rolling mill, detecting that the change in plate thickness has reached a rolling mill position based on speed of a rolled material, and then adjusting a screw-down amount of the rolling mill.

In Japanese Patent Application Laid-Open No. 2007-75850, a plate thickness meter is used. The thickness mater is installed between a controlled rolling stand and a preceding rolling stand, and this installation position is severe environment for the plate thickness meter. When the plate thickness meter is installed in the severe environment, wear of the plate thickness meter tends to progress, and the plate thickness meter may abruptly fail. Because of such circumstances, there is a problem that reliability of the plate thickness meter is low from the viewpoint of use in the AGC.

In addition, the plate thickness meter is economically expensive and costly to maintain. Therefore, there may be a case where the plate thickness meter is not used and the feedforward AGC is not performed. In this case, the feedforward AGC using the plate thickness meter cannot be performed to suppress skid mark thickness variations.

On the other hand, in the gauge meter AGC, if a load feedback is unstable, a gain in the gauge meter AGC cannot be increased. In the gauge meter AGC, a screw-down amount of rolls is adjusted with respect to a force change. The reason why the load feedback becomes instability is, for example, a case in which a load cell for detecting force may include a lot of noise, or a case in which force is detected not by the load cell but by an oil pressure type PT (Pressure Transducer). In such a case, since a gain in the gauge meter AGC cannot be increased, there is a problem that the gauge meter AGC cannot reduce a plate thickness variation caused by the skid mark.

As described above, there are many practical problems in a conventional technique to suppress a plate thickness variation due to the skid mark, and there is still room for improvement.

The present application has been made to solve the above-mentioned problems, and an object thereof is to provide a novel plate thickness control device and a novel plate thickness control method capable of suppressing plate thickness variation due to a skid mark.

Solution to Problem

A first plate thickness control device according to the present application for controlling a plate thickness in a hot rolling mill including a rolling stand, the plate thickness control device includes: a pyrometer disposed on an entry side of the rolling stand; a difference calculation part for outputting a difference temperature between a lock-on temperature of a plate-to-be-rolled measured by the pyrometer and a measurement value other than a head end portion of the plate-to-be-rolled measured by the pyrometer; a tracking part for transferring the difference temperature from a position of the pyrometer to a position immediately below the rolling stand based on a plate speed of the plate-to-be-rolled; and a computation part for computing a screw-down amount of the rolling stand based on the difference temperature transmitted from the tracking part.

A second plate thickness control device according to the present application for controlling a plate thickness in a hot rolling mill including a rolling stand, the plate thickness control device includes: a skid mark detecting part for detecting temperature information representing a position of a skid mark included in a plate-to-be-rolled rolled by the rolling stand based on a measurement value of a pyrometer disposed on an entry side of the rolling stand; a tracking part for transferring the temperature information to a position immediately below the rolling stand based on a plate speed of the plate-to-be-rolled; and a computation part for computing a screw-down amount of the rolling stand so as to determine force applied to the skid mark by the rolling stand based on the temperature information transferred by the tracking part.

A plate thickness control method according to the present application includes: obtaining a measured value of a pyrometer provided on an entry side of a rolling stand of a hot rolling mill; outputting a difference temperature between a lock-on temperature of a plate-to-be-rolled measured by the pyrometer and a measured value other than a head end portion of the plate-to-be-rolled measured by the pyrometer; transferring the difference temperature from a position of the pyrometer to a position immediately below the rolling stand based on a plate speed of the plate-to-be-rolled; and calculating a screw-down amount of the rolling stand based on the transferred difference temperature.

A plate thickness control method according to the present application includes: detecting temperature information representing a position of a skid mark included in a plate-to-be-rolled rolled at a rolling stand of the hot rolling mill based on a measurement value of a pyrometer disposed on an entry side of the rolling stand; transferring the temperature information to a position immediately below the rolling stand based on a plate speed of the plate-to-be-rolled; and calculating a screw-down amount of the rolling stand so as to determine force applied to the skid mark by the rolling stand based on the transferred temperature information.

Advantageous Effects of Invention

The present application can perform feed forward control based on temperature deviation of the plate-to-be-rolled by tracking difference temperature information acquired by the pyrometer. Thereby, it is possible to suppress the plate thickness variation due to the skid mark.

DESCRIPTION OF EMBODIMENTS

The present embodiment relates to a plate thickness control technique of a hot rolling mill 1 configured so that a plurality of rolling stands F1 to F7 are arranged in series and heated steel plates or the like are rolled in succession by these rolling stands F1 to F7.

Figure 1:
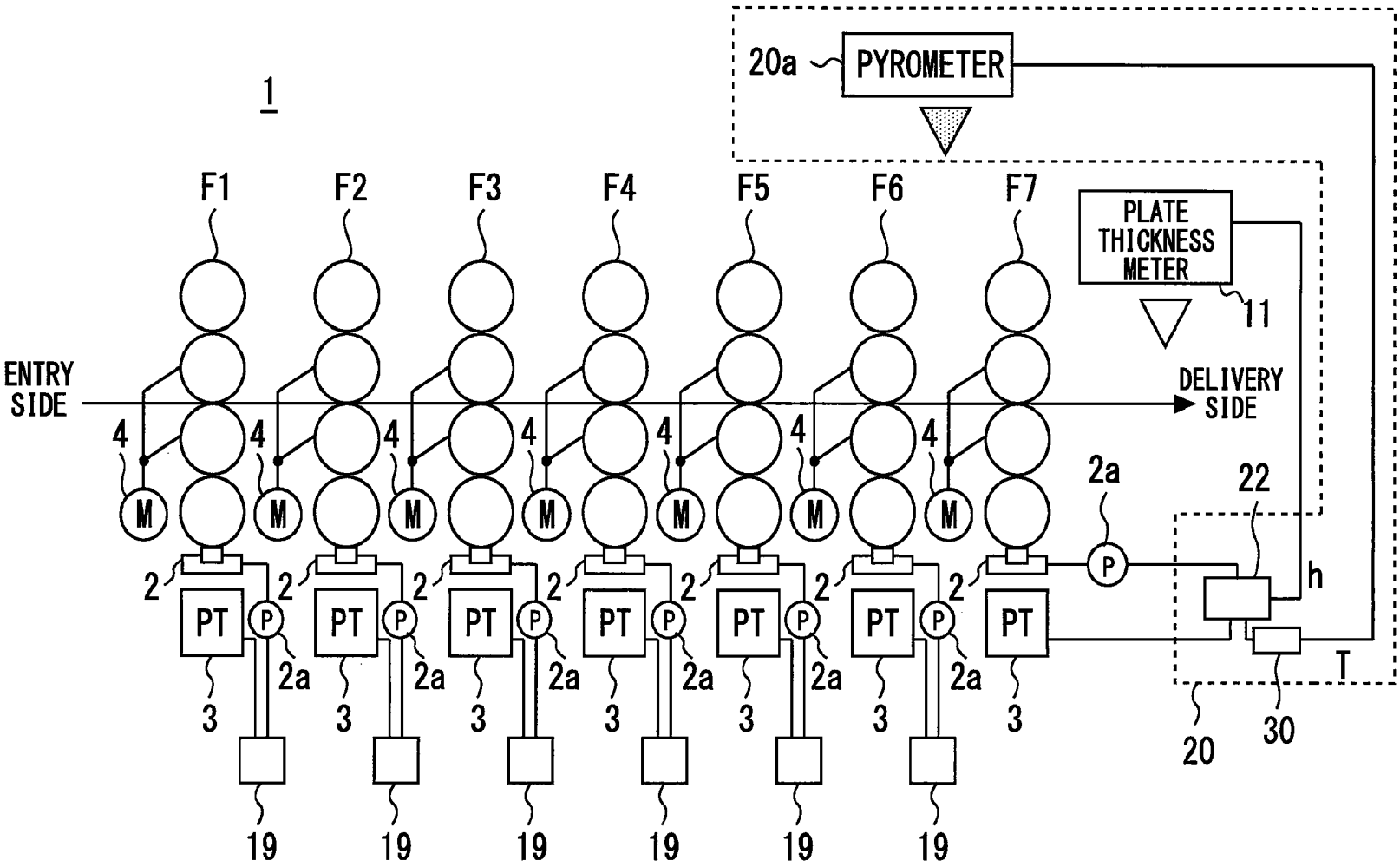
FIG. 1 is a diagram showing a configuration of a hot rolling mill on which a plate thickness control device according to an embodiment is mounted.

FIG. 1 is a diagram showing a configuration of the hot rolling mill 1 on which a plate thickness control device 20 according to the embodiment is mounted. The hot rolling mill 1 includes the plurality of rolling stands F1 to F7, a plurality of screw-down devices 2, a plurality of oil pressure regulating devices 2*a*, a plurality of oil pressure PTs 3, a plurality of electric motors 4, and a plate thickness meter 11.

The hot rolling mill 1 is a hot finishing rolling mill in which the plurality of rolling stands F1 to F7 are arranged in tandem. The plurality of rolling stands F1 to F7 include an initial rolling stand F1, intermediate rolling stands F2 to F6, and a final rolling stand F7. The plate thickness control device 20 according to the embodiment performs plate thickness control at the final rolling stand F7.

The screw-down device 2 is an oil driven screw-down device provided in each rolling stand. The screw-down device 2 includes an oil cylinder and an oil tank (not shown). The oil pressure regulating device 2*a* includes a valve and the like for regulating an oil pressure of the screw-down device 2.

The oil pressure PT 3 is a Pressure Transducer for measuring a load based on an oil pressure for driving the pressure screw-down device 2. The oil pressure PT 3 is an oil pressure sensor, and is also a load detector for detecting roll force of respective rolling stands.

The electric motors 4 rotate rolls of each rolling stand. The plate thickness meter 11 is disposed on a delivery side of the hot rolling mill 1. The plate thickness meter 11 can measure a plate thickness of a material-to-be-rolled which is rolled in the hot rolling mill 1.

The plate thickness control device 20 includes a pyrometer 20*a*, a screw-down control part 22, and a control calculation part 30. The plate thickness control device 20 can control a screw-down amount of the screw-down device 2 by controlling the oil pressure regulating device 2*a*. It should be noted that the screw-down amount of the screw-down device 2 is assumed to correspond to a roll gap change amount ΔΔS, and is also referred to simply as a "screw-down amount ΔS" hereinafter.

The pyrometer 20*a* is one of components of the plate thickness control device 20. The pyrometer 20*a* is disposed on the entry side of the final rolling stand F7, and more specifically, is disposed between the final rolling stand F7 and the rolling stand F6 which is a preceding stage thereof.

The screw-down control part 22 receives a plate thickness h which is an output signal from the plate thickness meter 11, an output signal from the control calculation part 30, and a load detecting signal from the oil pressure PT 3. The screw-down control part 22 generates a control signal based on those received signals to control the oil pressure regulating device 2*a*. The control calculation part 30 will be described later with reference to FIG. 2.

A front-stage plate thickness control device 19 is used as a control device for the initial rolling stand F1 and the intermediate rolling stands F2 to F6. A device in which the control calculation part 30 is omitted from the plate thickness control device 20 is the front-stage plate thickness control device 19, and except for this point, the front-stage plate thickness control device 19 and the plate thickness control device 20 are assumed to have the same configuration.

Figure 2:
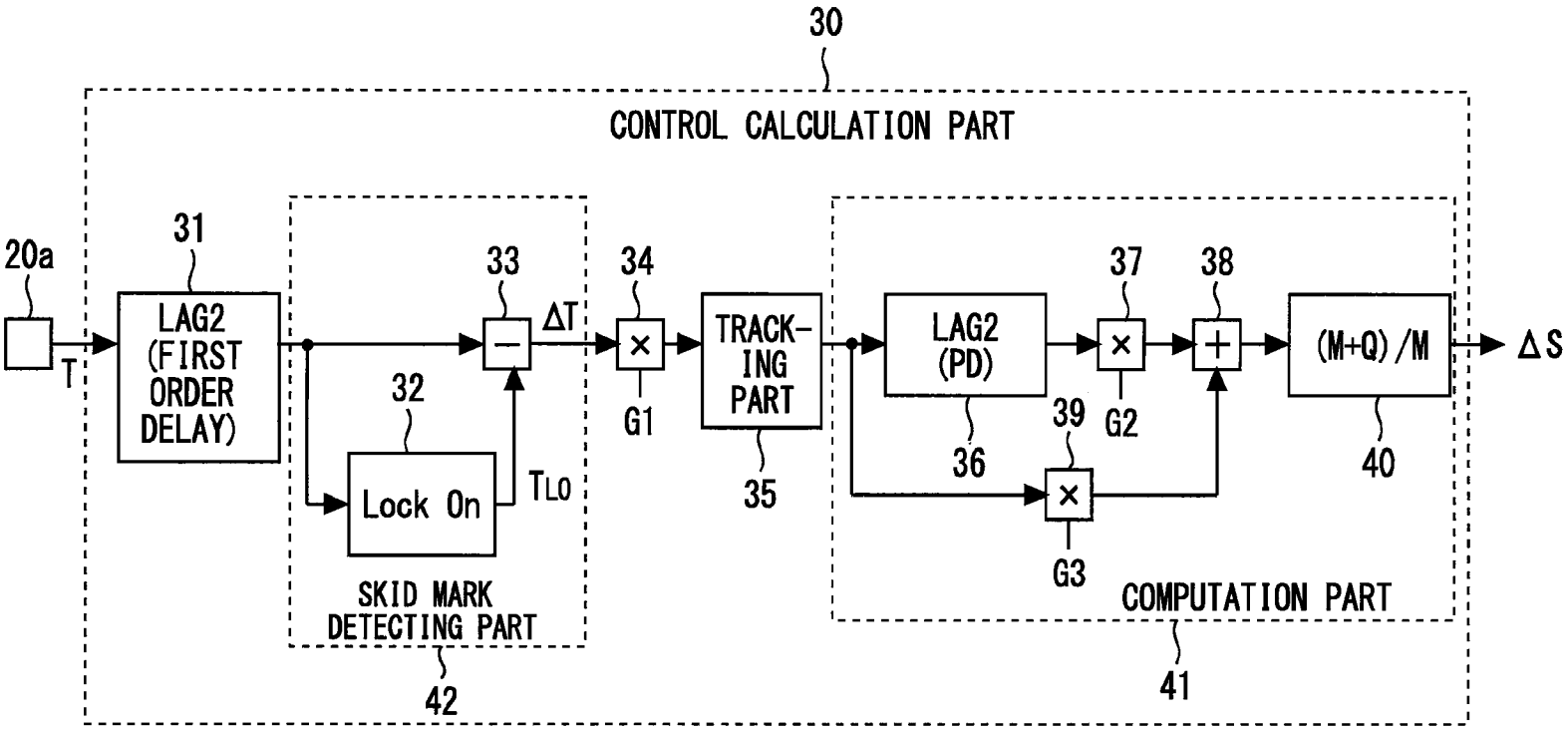
FIG. 2 is a control block diagram of a control calculation part included in the plate thickness control device according to the embodiment.

FIG. 2 is a circuit block diagram of the control calculation part 30 included in the plate thickness control device 20 according to the embodiment. As shown in FIG. 2, the control calculation part 30 includes a first-order delay filter part 31, a lock-on temperature acquisition part 32, a difference calculation part 33, a first gain part 34, a tracking part 35, and a computation part 41.

The first-order delay filter part 31 performs on the output signal of the pyrometer 20*a* a first-order delay calculation which is set in advance.

The lock-on temperature acquisition part 32 acquires a lock-on temperature $T_{LO}$ of the plate-to-be-rolled measured by the pyrometer 20*a* based on the output signals of the pyrometer 20*a*. The "lock-on temperature $T_{LO}$" is a temperature of a portion in the vicinity of the head end of the material-to-be-rolled. This lock-on temperature $T_{LO}$ can be used as a reference temperature for detecting skid marks. A temperature of the head end of the material-to-be-rolled may be the lock-on temperature $T_{LO}$, or a temperature of a portion slightly inside from the head end of the material-to-be-rolled may be the lock-on temperature $T_{LO}$.

The difference calculating part 33 receives an output signal from the first-order delay filter part 31 and the lock-on temperature $T_{LO}$ from the lock-on temperature acquisition part 32. The output signal of the first-order delay filter part 31 includes "a temperature measurement value for a portion other than the head end portion of the plate-to-be-rolled" measured by the pyrometer 20*a*. The difference calculation part 33 outputs a difference temperature ΔT. The difference temperature ΔT is a difference between the lock-on temperature $T_{LO}$ and the "temperature measurement value for the portion other than the end portion of the plate-to-be-rolled".

The first gain part 34 receives an output from the difference calculation part 33. The first gain part 34 multiplies the difference temperature ΔT outputted from the difference calculation part 33 by a predetermined first gain G1. In the following description, in order to simplify the description, the difference temperature ΔT multiplied by the first gain G1 is also simply referred to as the "difference temperature ΔT" unless it is necessary to distinguish it.

The tracking part 35 receives an output from the first gain part 34. The tracking part 35 transfers the difference temperature ΔT from a position of the pyrometer 20*a* to directly below the final rolling stand F7 based on a plate speed of the plate-to-be-rolled. The method of detecting the plate speed may be achieved using any of various known techniques, and therefore description thereof will be omitted. For example, the plate speed may be detected by providing a plate speed meter (not shown), or the plate speed may be detected from a rotation speed or the like of the electric motors 4.

The computation part 41 calculates a screw-down amount ΔS of the final rolling stand F7 based on the difference temperature ΔT transmitted from the tracking part 35. Specifically, the computation part 41 includes a proportional-differential control part 36, a second gain part 37, a third gain part 39, an adding part 38, and a screw-down amount calculation part 40.

The proportional-differential control part 36 performs proportional differential control (PD control) on the difference temperature ΔT. According to the proportional-differential control part 36, both the proportional control (P control) and the phase advance compensation (D control) can be performed on the temperature deviation (difference temperature ΔT) tracked up to directly below the rolling stand F7 which is to be controlled.

The second gain part 37 multiplies an output of the proportional-differential control part 36 by a second gain G2. The third gain part 39 multiplies an output of the tracking part 35 by a third gain G3. The adding part 38 adds an output of the second gain part 37 and an output of the third gain part 39.

The screw-down amount calculation part 40 calculates the screw-down amount ΔS based on the output value of the proportional-differential control part 36 and rolling parameters. The rolling parameters include a mill constant M and a plasticity coefficient Q.

As described above, according to the embodiment, by tracking the difference temperature ΔT acquired by the pyrometer 20*a*, feed forward control based on the temperature deviation of the plate-to-be-rolled can be performed. As a result, it is possible to suppress plate thickness variation due to the skid mark. That is, the plate thickness control device 20 according to the embodiment can control the screw-down amount of the final rolling stand F7, which is a control target, with high accuracy by performing both the phase advance compensation (D control) and the proportional control (P control) on the difference temperature ΔT tracked by the tracking part 35 directly below the rolling stand F7. By using the screw-down amount ΔS calculated by the computation part 41 to accurately suppress the plate thickness variation due to the skid mark while adding other AGCs, it is possible to converge a delivery side plate thickness to a target plate thickness.

According to the embodiment, a preferable example is provided in which the screw-down control part 22 controls the screw-down device 2 based on the oil pressure measured by the oil pressure PT 3 and the screw-down amount ΔS calculated by the computation part 41. There is a disadvantage that the screw-down amount ΔS calculated based on the oil pressure PT 3 is less accurate than a screw-down amount ΔS calculated by using a load cell. In this respect, the computation part 41 determines the screw-down amount ΔS based on the difference temperature ΔT tracked by the tracking part 35, whereby the plate thickness control accuracy can be suppressed from decreasing.

In the embodiment, the hot rolling mill 1 does not include a load cell for detecting rolling force of the rolling stands F1 to F7. Nevertheless, the computation of the screw-down amounts ΔS includes not only the load detecting signals of the oil pressure PT 3 but also the difference temperature ΔT tracked by the tracking part 35, and thereby the plate thickness variation of the skid mark can be sufficiently suppressed. As a result, the plate thickness variation of the skid mark can be suppressed even if there is no load cell, and thus the load cell, which is an expensive device, may be omitted. Even when load cells are not provided as load detectors of each of the rolling stands F1 to F7 and the load detection of the oil pressure PT (Pressure Transducer) or the like is unstable, the plate thickness control device 20 can converge a plate thickness at the delivery side of the rolling stand to the target plate thickness. However, the plate thickness control device 20 according to the present embodiment may also be applied to the hot rolling mill 1 with a load cell.

According to an embodiment, a preferable example having the proportional-differential control part 36 is provided. This makes it possible to perform phase advance compensation by differential control (D control) as well as proportional control (P control), thereby suppressing plate thickness deviation caused by the skid mark with high accuracy.

The lock-on temperature acquisition part 32 and the difference calculation part 33 according to the embodiment correspond to a "skid mark detection part 42". The skid mark detecting part 42 can detect temperature information (that is, the difference temperature ΔT) indicating the position of the skid mark included in the plate-to-be-rolled, based on the measurement value of the pyrometer 20*a*. The computation part 41 can calculate the screw-down amount ΔS of the final rolling stand F7 so as to determine force applied to the skid mark at the final rolling stand F7 based on the temperature information (difference temperature ΔT) transferred by the tracking part 35.

The pyrometer 20*a* acquires temperature information indicating the position of the skid mark, and on the basis of the tracking of the temperature information, it can be specified that the skid mark has reached immediately below the final rolling stand F7. As a result, the screw-down amount ΔS can be correctly calculated so that the final rolling stand F7 applies an appropriate force to the skid mark.

It should be noted that the control calculation part 30 shown in FIG. 2 may be configured of either an analog circuit or a digital circuit, may be configured in the form of a dedicated processing device, or may be constructed in the form of a general-purpose operation circuit including a CPU and a memory. The constituent elements of each of the above-mentioned " . . . part(s)" may be provided as software function blocks by being replaced with " . . . block(s)".

It should be noted that, although the plate thickness control device 20 according to the embodiment is applied only to the final rolling stand F7 in the embodiment, the plate thickness control device 20 may be applied to the rolling stands F1 to F6 while providing the pyrometer 20*a* on each entry side thereof, as a modification.

Although the hot rolling mill 1 having a plurality of rolling stands F1 to F7 has been described in the embodiment, the hot rolling mill 1 may be modified to have only one rolling stand F7. Also in this case, by using the temperature information of the pyrometer 20*a* in the case where load detection is unstable, it is possible to obtain an advantage that the plate thickness accuracy can be improved.

It should be noted that the plate thickness control device according to the embodiment may be provided as a "plate thickness control method of a hot rolling mill" by dividing each control process into steps. The plate thickness control method according to the embodiment is also implemented by adding each function of the plate thickness control device 20 (refer to FIG. 2) to a plate thickness control device of an existing hot rolling mill, and the subsequent addition corresponds to an action of manufacturing the plate thickness control device 20 according to the embodiment.

REFERENCE SIGNS LIST

1 Hot rolling mill
2 Screw-down device
2*a* Oil pressure regulating device
3 Oil pressure PT (Pressure Transducer)
4 Electric motor
11 Plate thickness meter
19 Front-stage plate thickness control device
20 Plate thickness control device
20*a* Pyrometer
22 Screw-down control part
30 Control calculation part
31 First-order delay filter part
32 Lock-on temperature acquisition part
33 Difference calculation part
34 First gain part
35 Tracking part
36 Proportional-differential control part
37 Second gain part
38 Adding part
39 Third gain part
40 Screw-down amount calculation part
41 Computation part
42 Skid mark detecting part
F1 Rolling stand (initial rolling stand)
F2-F6 Rolling stand (intermediate rolling stand)
F7 Rolling stand (final rolling stand)
$T_{LO}$ Lock-on temperature
ΔS Screw-down amount (roll gap change amount)
ΔT Difference temperature

The invention claimed is:

1. A plate thickness control device for controlling the plate thickness in a hot rolling mill with a rolling stand, the plate thickness control device comprising:

a pyrometer disposed on an entry side of the rolling stand;

a difference calculation part configured to output a difference temperature between a lock-on temperature of a plate-to-be-rolled measured by the pyrometer and a measurement value other than a head end portion of the plate-to-be-rolled measured by the pyrometer;

a tracking part configured to transfer the difference temperature from a first position of the pyrometer to a second position immediately below the rolling stand based on a plate speed of the plate-to-be-rolled; and a computation part configured to calculate a screw-down amount of the rolling stand based on the difference temperature transmitted from the tracking part, wherein the computation part includes a control part configured to perform, at least, differential control on the difference temperature, and a screw-down amount calculation part configured to calculate the screw-down amount based on an output value of the control part.

2. The plate thickness control device according to claim 1, wherein the rolling stand includes an oil pressure type screw-down device, and an oil pressure sensor configured to measure an oil pressure of the screw-down device, and wherein the plate thickness control device further comprises a screw-down control part that controls the screw-down device based on the oil pressure measured by the oil pressure sensor and the screw-down amount calculated by the computation part.

3. The plate thickness control device according to claim 1, wherein the hot rolling mill does not include a load cell configured to detect rolling force of the rolling stand.

4. The plate thickness control device according to claim 1, wherein the control part is configured not to include an integral control part for performing integral control on the differential temperature.

5. A plate thickness control device for controlling a plate thickness in a hot rolling mill with a rolling stand, the plate thickness control device comprising:

a skid mark detecting part configured to detect temperature information representing a first position of a skid mark included in a plate-to-be-rolled rolled at the rolling stand based on a measurement value of a pyrometer disposed on an entry side of the rolling stand;

a tracking part configured to transfer the temperature information to a second position immediately below the rolling stand based on a plate speed of the plate-to-be-rolled; and a computation part configured to calculate a screw-down amount of the rolling stand so as to determine force applied to the skid mark by the rolling stand based on the temperature information transferred at the tracking part, wherein the computation part includes a control part configured to perform, at least, differential control on the temperature information, and a screw-down amount calculation part configured to determine the force applied to the skid mark based on an output value of the control part.

6. A plate thickness control method comprising:

obtaining a measured value of a pyrometer disposed on an entry side of a rolling stand of a hot rolling mill;

outputting a difference temperature between a lock-on temperature of a plate-to-be-rolled measured by the pyrometer and a measured value of a portion other than a head end portion of the plate-to-be-rolled measured by the pyrometer;

transferring the difference temperature from a first position of the pyrometer to a second position immediately below the rolling stand based on a plate speed of the plate-to-be-rolled;

performing, at least, differential control on the differential temperature which is transferred to the second position; and calculating a screw-down amount of the rolling stand based on the difference temperature on which the differential control is performed.

* * * * *